United States Patent [19]

Freermann

[11] Patent Number: 4,881,479

[45] Date of Patent: Nov. 21, 1989

[54] METHOD OF TRANSVERSELY SUBDIVIDING AN ELONGATED FLEXIBLE WEB

[75] Inventor: Johannes Freermann, Ochtrup, Fed. Rep. of Germany

[73] Assignee: Carl Schmale GmbH & Co. KG, Ochtrup, Fed. Rep. of Germany

[21] Appl. No.: 210,149

[22] Filed: Jun. 17, 1988

Related U.S. Application Data

[63] Continuation-in-part of Ser. No. 76,593, Jul. 23, 1987, abandoned.

[30] Foreign Application Priority Data

Jul. 24, 1986 [DE] Fed. Rep. of Germany ..... 3624994

[51] Int. Cl.[4] ..... D05B 1/00; D05B 27/00

[52] U.S. Cl. ..... 112/262.3; 112/121.15; 112/304; 198/512; 198/376; 271/10; 271/264

[58] Field of Search ..... 112/262.3, 262.2, 262.1, 112/121.12, 121.11, 121.15, 304, 303; 198/512, 376; 271/10, 13, 264

[56] References Cited

U.S. PATENT DOCUMENTS

| | | | |
|---|---|---|---|
| 2,546,527 | 3/1951 | Smyth | 112/304 |
| 3,208,418 | 9/1965 | Frydryk | 112/304 |
| 3,467,037 | 9/1969 | Frydryk | 112/121.15 |
| 4,432,295 | 2/1984 | Rasin et al. | 112/262.3 |
| 4,483,266 | 11/1984 | Olasz et al. | 112/121.11 X |
| 4,499,834 | 2/1985 | Ruetschle et al. | 112/121.11 X |
| 4,693,460 | 9/1987 | Adamson et al. | 271/10 |
| 4,756,262 | 7/1988 | Wilson | 112/304 |
| 4,821,656 | 4/1989 | Dordi et al. | 112/304 X |

*Primary Examiner*—H. Hampton Hunter

*Attorney, Agent, or Firm*—Herbert Dubno; Andrew Wilford

[57] ABSTRACT

Pieces are cut off the end of a long web by first impaling the leading end of the web on a crosswise circulating needle bar that is then moved downstream from a cutting to a holding section. Then at the cutting station another such circulating needle bar and a noncirculating needle bar are poked through the web, with the noncirculating bar being downstream (relative to the displacement direction of the web) of the circulating bar. Then the web is cut across between the two upstream bars and the noncirculating bar and the downstream circulating bar are dropped down to transfer the piece thus cut from themselves to a transverse needle-chain conveyor. Then the circulating bar is moved back from the downstream holding station to the upstream cutting station while the second circulating bar pulls another piece of the web downstream across above the transverse conveyor.

4 Claims, 10 Drawing Sheets

METHOD OF TRANSVERSELY SUBDIVIDING AN ELONGATED FLEXIBLE WEB

FIELD OF THE INVENTION

My present invention relates to a method of crosscutting a flexible textile web prior to hemming or seaming it. More particularly this invention relates to a process wherein the web of unfinished goods or other material (e.g. normally terry cloth) is fed from a receiving table, a roll, or the like with its longitudinal edges held fixed and extending in a direction transverse to a working unit provided with a crosscutter and another working station including at least one hemming and sewing station. The crosscutter cooperates with an aligning station and the web of goods is fed from a transport device to the hemming and sewing station.

BACKGROUND OF THE INVENTION

Conrad Arbter German Pat. No. 2,544,410 describes an apparatus for aligning and cutting a web of unfinished material, e.g. terry cloth, which is provided with an aligning device slidable in the feed direction of the web and a cutter working transversely to the feed direction.

In this patent several braking elements positioned next to one another act on the web of material during the alignment. The aligner comprises several aligning elements movable independently of one another and positioned side by side.

German Pat. No. 3,047,972 describes a device for continuously forming a double hem at least in the vicinity of the edges of a flat web of material. Subsequently the hemmed web is fixed in a working station by sewing, an adhesive or heat sealing. The folding devices are to this end spaced apart in the feed direction of the web of material. Feed belts are provided which move the web of material forward past the folding members in the vicinity of the edges.

OBJECTS OF THE INVENTION

It is an object of my invention to provide an improved method of crosscutting a flat web of material, particularly of sponge or nap cloth.

It is another object of my invention to provide an improved method of crosscutting a flat web of material, particularly of sponge or nap cloth, which performs all operations substantially completely automatically and allows output of a higher quality product.

SUMMARY OF THE INVENTION

A method of cutting pieces from an elongated flexible web and delivering the pieces to a treatment machine according to my invention comprises the steps of first feeding a leading edge of the web to a cutting station downstream in a longitudinal direction with the edge extending transversely and affixing the leading edge at the cutting station to a first one of a plurality of transversely extending circulating needle bars. The first needle bar is then advanced longitudinally downstream away from the cutting station to a holding station spaced downstream from the cutting station and is arrested in the holding station, pulling a piece of the web out so that it spans between the cutting and holding stations. Then the web is affixed at the cutting station to a second one of the transversely extending circulating needle bars and, closely but spacedly downstream therefrom, to a noncirculating needle bar. While maintaining the first and second circulating bars and the noncirculating needle bar substantially stationary, the web is then cut transversely between the second circulating bar and the noncirculating bar so as to cut a piece from the web, this piece being spanned between a trailing edge at the noncirculating bar and a leading edge at the first circulating needle bar. The noncirculating and first circulating needle bars with the web piece spanned between them are then dropped so as to transfer the piece to a conveyor extending transversely from between the stations to the treatment machine for conveyance of the piece away on the conveyor toward the treatment machine. Then the second circulating needle bar is advance longitudinally downstream away from the cutting station to the holding station and is arrested in the holding station. Thereupon at the cutting station the web is affixed to another one of the transversely extending circulating needle bars and, closely but spacedly downstream therefrom, to the noncirculating needle bar. The steps of cutting the web and dropping the two bars holding the cut piece are then repeated.

This method therefore allows pieces to be accurately cut from a web extending in a main longitudinal direction and fed out transversely to further treatment stages such as selvedging devices.

According to another feature of the invention the piece is conveyed away transversely to the upstream-to-downstream direction of displacement of the uncut web by a conveyor extending transversely below the holding and cutting stations. The circulating needle bars are then each passed after the web is transferred to the conveyor upstream underneath the transverse conveyor toward the cutting station.

The web is clamped between upper and lower clamping elements upstream and downstream of the cutting station during the cutting operation. In addition to speed operation more than two such circulating bars are used and same are passed from the holding station to the cutting station by being moved downward from the holding station, then upstream toward the cutting station, and finally upward to the cutting station. In accordance with a preferred embodiment four such circulating bars are used.

With the process and apparatus according to my invention an endless flat web of material can be worked in an economical way and a higher quality product produced. In a simple way the apparatus can be made to fit webs of material of different dimensions. By superposition of the individual process steps a high operating speed is attained as well as completely automatic operation.

BRIEF DESCRIPTION OF THE DRAWING

The above and other objects, features and advantages of my invention will become more readily apparent from the following description, reference being made to the accompanying highly diagrammatic drawing in which:

FIGS. 3A through 30 are small-scale schematic views illustrating the positions of the needle bars, various other elements of the apparatus, and the workpiece during the various steps of the method of this invention;

FIG. 4 is a larger-scale schematic side elevational view of the apparatus as seen in the direction of the arrow II of FIG. 1 near the cutting station;

FIG. 5 is an enlarged side elevational view of the holder of the apparatus of FIG. 1;

FIG. 6 is a side elevational view of a needle chain of the apparatus of FIG. 1;

FIG. 7 is a diagram illustrating the path followed by the needle bars at the upstream end of the device;

FIG. 8 is a diagram illustrating the path followed by the circulating needle bars in upper level I;

FIG. 9 is a diagram illustrating the path followed by the circulating needle bars at the downstream end of the device; and FIG. 10 is a diagram illustrating the path followed by the circulating needle bars in lower level IV.

SPECIFIC DESCRIPTION

Figure 1:
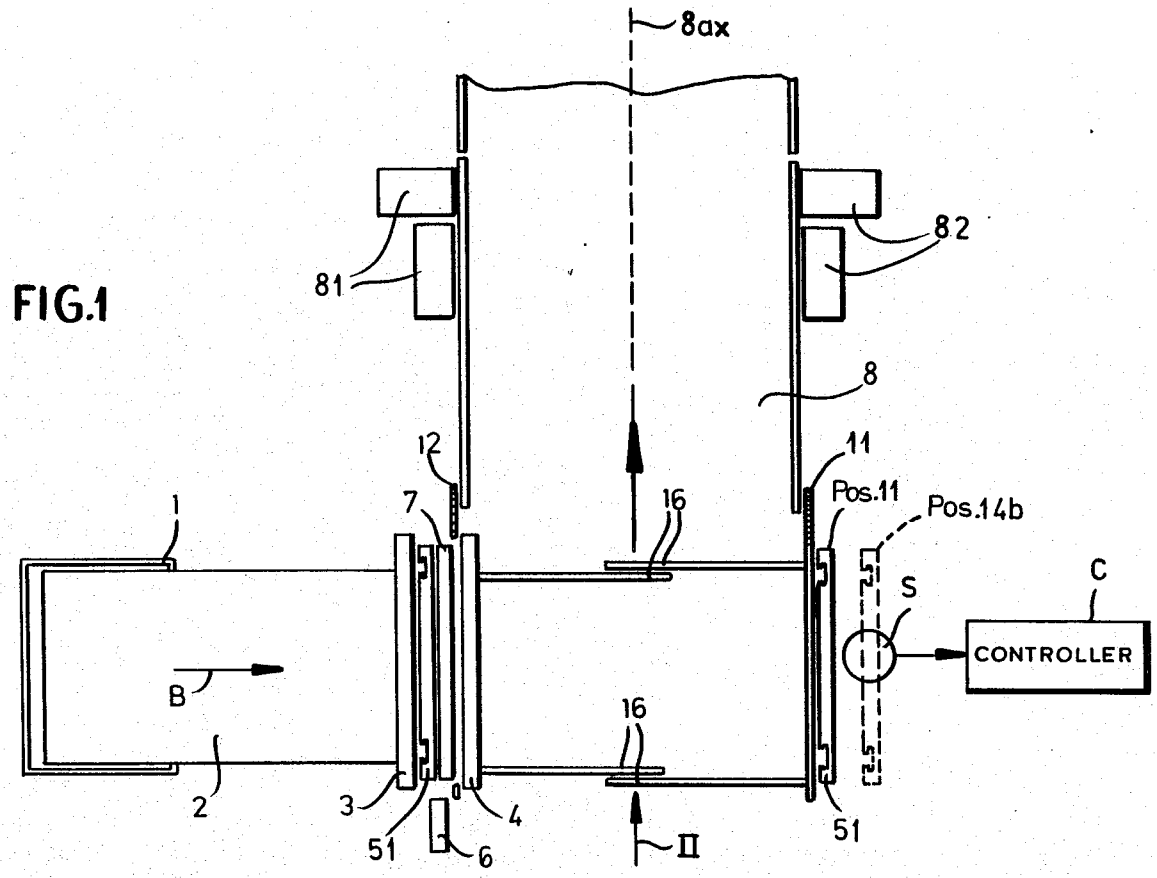
FIG. 1 is a top plan view of the essential parts of an apparatus for crosscutting, hemming, and sewing according to my invention.

FIG. 1 shows the apparatus according to my invention from above. The machine is substantially L-shaped and comprises a receiving table 1 and a working unit 8 on which at least one hemming machine 81 and at least one sewing station 81 are mounted. Instead of or in addition to these hemming and sewing machines 81 and 82, any other working elements could be provided according to the designer's choice.

The flat web of material 2, which in this case is sponge or terry cloth and which is on the receiving table 1 (and which can also come from a roll of the web or any other source thereof) is fed in a direction B to the working unit 8. The flat web 2 has advantageously fixed longitudinal edges and has not shown napless portions running transverse to the longitudinal edges.

Before starting the apparatus the web of material 2 is affixed to upstanding needles of a first circulating needle bar 51. After that each further operation takes place automatically.

The web of material 2 is pulled by the needle bar 51 in the direction B transverse to the longitudinal axis 8*ax* of the working unit 8 downstream into the working unit 8 until the first needle bar 51 with the leading portion of the web 2 has reached an extreme position 14*b* which is located at the downstream side of the working unit 8 and whose position is determined by a retaining impulse which is emitted by a sensor S contacting or detecting the nap edge on a napless portion of the web of material 2 and connected to a machine controller C.

The first needle bar 51 then is pulled back to a position 11 located upstream of the extreme position 14*b* to permit alignment and crosscutting.

An aligning/cutting station is located upstream of the working unit 8 at the starting end of the web of material 2 and comprises two aligning bars 3,4 of which one bar 3 is laterally and vertically movable while the other bar 4 is laterally stationary but vertically movable. The extent of displacement occurring as aligning bar 3 moves upstream from the other aligning bar 4 is controlled by the width of the not shown napless portion of the web of material 2. Needle bars are provided between both aligning bars 3,4. Adjacent strip 3 there are positioned as the machine cycles the first, second, third and fourth circulating needle bars 51, 52, 53 and 54 and on the other side a fourth noncirculating needle bar 7.

The web 2 is held fixed on its napless zone by one of the needle bars 51, 52, 53, or 54 and by the needle bar 7 to maintain the aligned condition.

Figure 4:
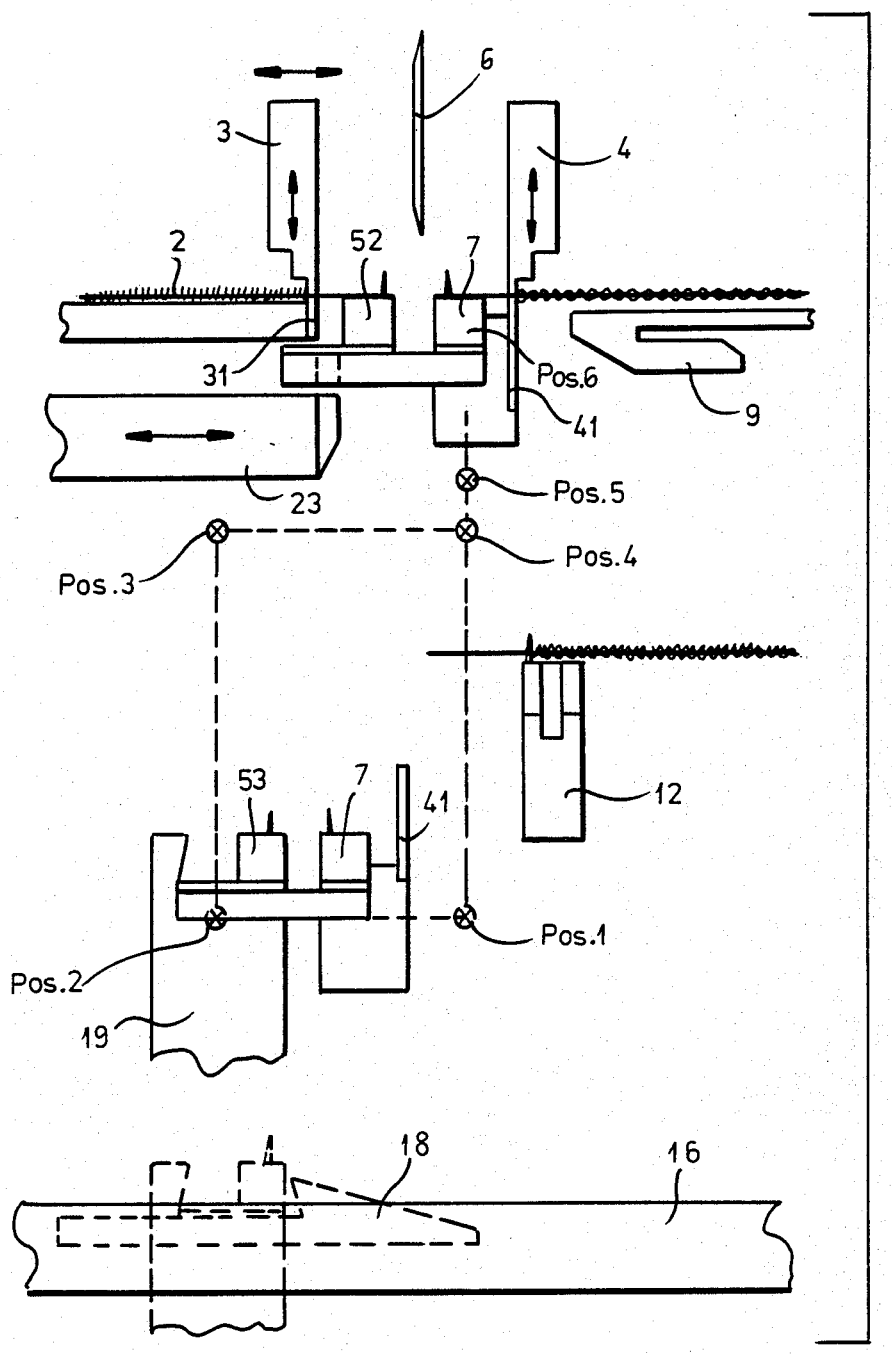

After the web 2 is fixed in position it is cut between one of the circulating needle bars 51, 52, 53 or 54 and the noncirculating needle bar 7 by a running crosscutter 6 (FIG. 4). This process occurs in the uppermost or first level I under which the second, third and fourth levels II to IV are located (FIG. 2).

Along each side of the working unit 8 is a pair of parallel rails 16 having inner ends that overlap each other in an area between the working unit sides. The rails 16 extending from opposite sides are not fixed to one another and thus provide for adjustment of the machine to different material lengths. Needle chains 11,12 are provided on both longitudinal sides of the machine. Their function is described in more detail below.

Figure 2:
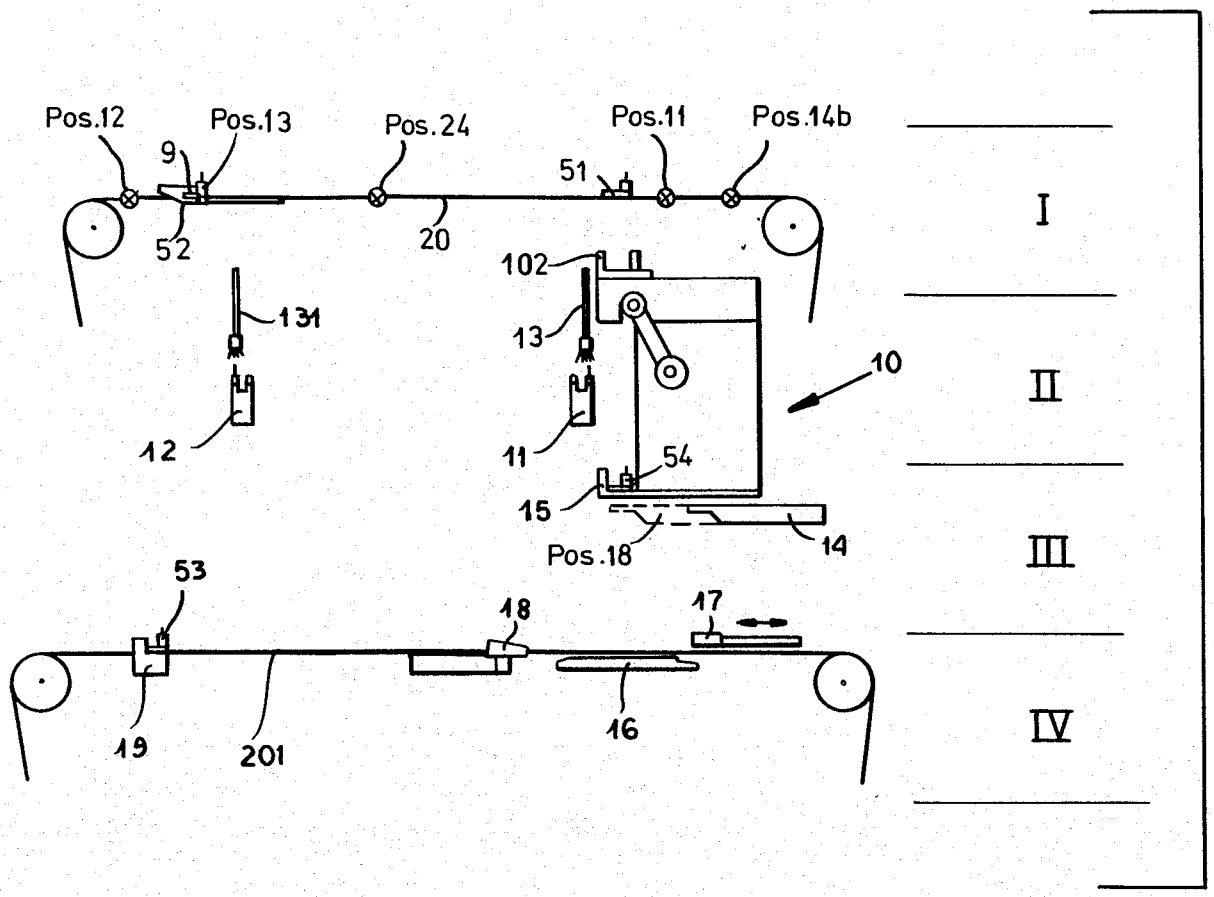
FIG. 2 is a large-scale side schematic elevational view of essential parts of the apparatus as seen in the direction of the arrow II of FIG. 1.

FIG. 2 shows a side view of the machine in the direction of arrow II of FIG. 1. The first needle bar 51 is passed with the web 2 impaled on it by a feed belt pair 20 to the downstream side of the working unit 8 by a fetch hook 9 mounted on the belt 20. During this motion a second needle bar 52 is engaged from below in the receiving position 13. The fetch hook 9 is then moved by the one feed belt pair 20 to a waiting position 24 from which it reaches by passing a turning point 12 the receiving position 13 to take the second needle bar 52.

As is apparent from FIG. 2 the holder 10 which moves down after receiving the first needle bar 51 with the web 2 impaled on it is located under the receiving position 11. It deposits the web 2 on the needle chain 11 in the second level II. The placing of the web 2 on the needle chain 11 is facilitated by a movable brush 13 which performs a substantially vertical motion and pushes the web 2 down onto the needles of the needle chain 11. Still further below in the third level III the empty first needle bar 51 is taken off the holder 10 by a slider 14 at a position 18 where simultaneously an empty fourth circulating needle bar 54 is deposited on a rail 16 in the fourth level IV.

Figure 5:
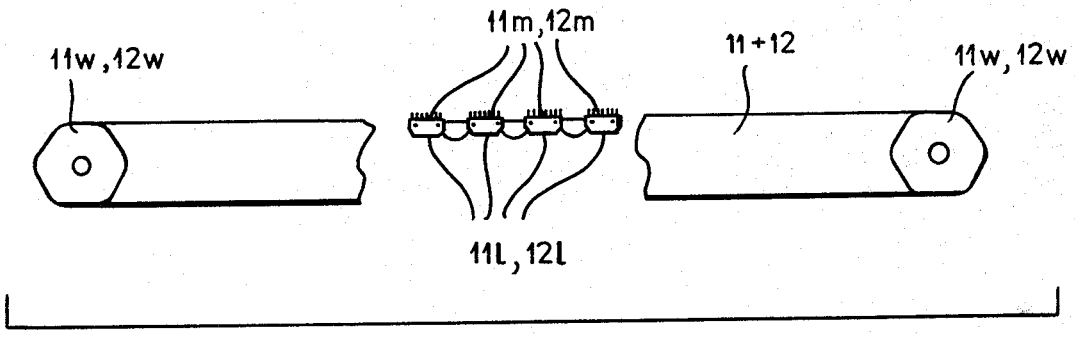

The holder 10 is shown in detail in FIG. 5. It comprises a vertically movable main body 101 at whose bottom a forklike bottom hook 15 is rigidly attached. On the upper portion of the main body 101 an upper hook 102 is mounted on a carriage 103 which is movable back and forth transverse to the main body 101 of the holder 10 and which travels to and fro with the main body 101. Similarly a movable clamping hook 21 is pivotally mounted on the carriage 103 and can be brought toward the upper hook 102 into a clamping position by the piston rod 22*r* of a pneumatic piston 22.

FIG. 4 shows the process on the upstream side of the machine. One sees that both aligning bars 3, 4 cooperate with opposing bars 31, 41. While the opposing bar 31 is movable laterally only in a first level I to come into active connection with the one aligning bar 3, the opposing bar 41 can move from a starting position 6 in which it coacts with the other aligning bar 4 to perform a downward motion through upper and lower intermediate positions 5 and 4 to a deposit position 1.

In the illustrated case the needle bars 52 and 7 hold the web 2 in its napless portion. After fixing the web 2 in position cutting occurs between the second and fourth needle bars 52 and 7 by the crosscutter 6 to sever from the web 2 a piece that is left spanned between the bars 7 and 51.

After the cutting, the fetch hook 9 pulls the second needle bar 52 to its receiving position 13.

At the same time as the deposit of the web 2 on the downstream side of the machine on the needle chain 11

(FIG. 1), the fourth needle bar 7 with the upstream end of the web 2 impaled on it moves from starting position 6 downward to the deposit position 1. The portion of the web 2 caught on the bar 7 as it passes the needle chains 12 is impaled with the aid of a movable brush 131 on the needle chain 12 (FIG. 4). The first part of the web 2 is thus free on the needle chains 11, 12 and can be fed from them to the machines 81 and 82.

Figure 8:
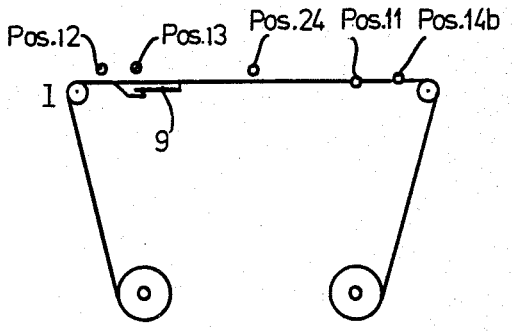

After deposit of that portion of the web 2 the fetch hook 9 with the second needle bar 52 moves to the extreme position 14*b* (FIGS. 1 and 8).

As is apparent from FIG. 4 the first opposing bar 41 with the fourth needle bar 7 after reaching deposit position 1 is pushed laterally into release position 2 where the third needle bar 53 is taken off a lifter 19 which has previously brought the third needle bar 53 from the rail 16 in the fourth level IV to release position 2. Both needle bars 53 and 7 are then spaced from one another next to one another and jointly move upward together with the first opposing bar 41 into a return position 3 and from there laterally into a lower intermediate position 4.

From the lower intermediate position 4 the opposing bar 41 travels upward into an upper intermediate position 5 where the second needle bar 52 engages in a laterally movable puller 23.

From upper intermediate position 5 the opposing bar 41 moves upward into the starting position 6 and thus into active connection with the other aligning bar 4.

The one aligning bar 3 contacting the nap edge which has moved away from the laterally fixed other aligning bar 4 an amount corresponding to the width of the napless portion of the web 2 is connected in operation with the other opposing bar 31 in this motion.

The puller 23 engaged with the second needle bar 52 performs a lateral motion to bring the second needle bar 52 vertically under its attached position.

After the aligning process by the aligning bars 3, 4 and the opposing bars 31 and 41 is ended, the needle bars 53 and 7 move up from upper intermediate position 5 to starting position 6 to hold the aligned web of material fixed.

During this upward motion the third needle bar 53 uncouples from the puller 23. In the fourth level IV a return hook 18 is provided on another feed belt pair 201 which acts to move the needle bars to the lifter 19.

Figure 6:
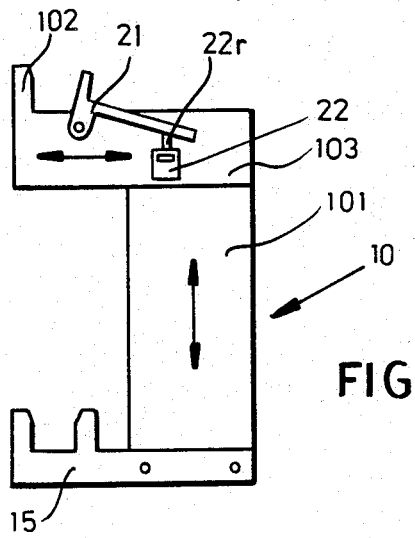

FIG. 6 shows the needle chains 11, 12 which are open link chains which move endlessly about two sprocket wheels 11*w*, 12*w*. The metallic chain link members 111, 121 are provided with a plurality of needles 11*m*, 12*m*. The curved link members 111, 121, which protrude downward and are made of wear resistant plastic, guide the needle chain 11, 12 on linear members on both side walls of the working unit 8.

More specifically as seen in FIGS. 3A through 30 the system steps through fifteen basic stages in an operating cycle in which it cuts a piece 2′ off the goods 2 and is ready to cut off another such piece 2′.

Figure 3A:
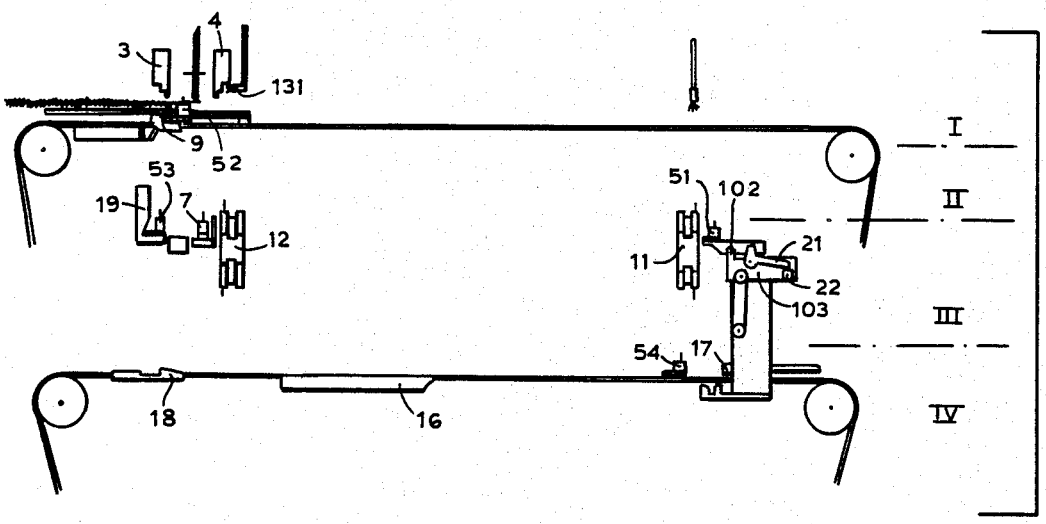
Figure 7:
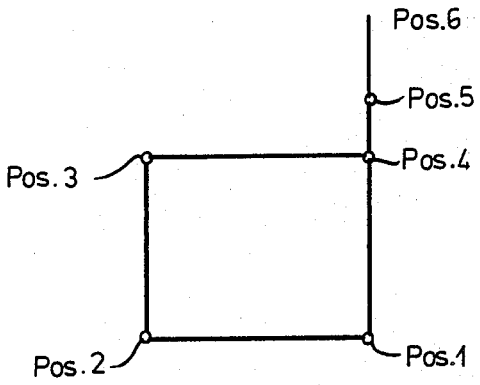

In the starting position of FIG. 3A the circulating needle bar 52 is in position 13 of FIG. 2 in the cutting station formed at positions 12 and 13 and the leading edge of the textile web 2 is impaled on its needles. The noncirculating needle bar 7 and counter bar 41 are in position 1 as seen in FIGS. 4 and 7 somewhat below the cutting station and out of contact with the web 2. The circulating needle bar 54 is in level IV on the belts 20 under the holding station formed at positions 11 and 14*b*. The other circulating needle bar 53 is on the lifter 19 in the position 2 of FIGS. 4 and 7 and the return hook 18 is underneath it as shown in dashed lines in FIG. 4. The pusher 17 is in the extreme downstream (right-hand in FIG. 2) position and the hook 9 is in position 13.

The last circulating needle bar 51 is on the slide 14 which is advanced into its upstream position 18 which is the position it is normally in. The hook 15 is below the rails 16 and the clamp hook 21 of the body 101 is in the open position. The beams 3 and 4 are in the position of FIG. 4 with the counter beam 31 also in the position of FIG. 4 while the other counter beam 41 is down with the lowered needle bar 7 with which it is integral. The crosscutter 6 is either lifted or laterally retracted.

Figure 3B:
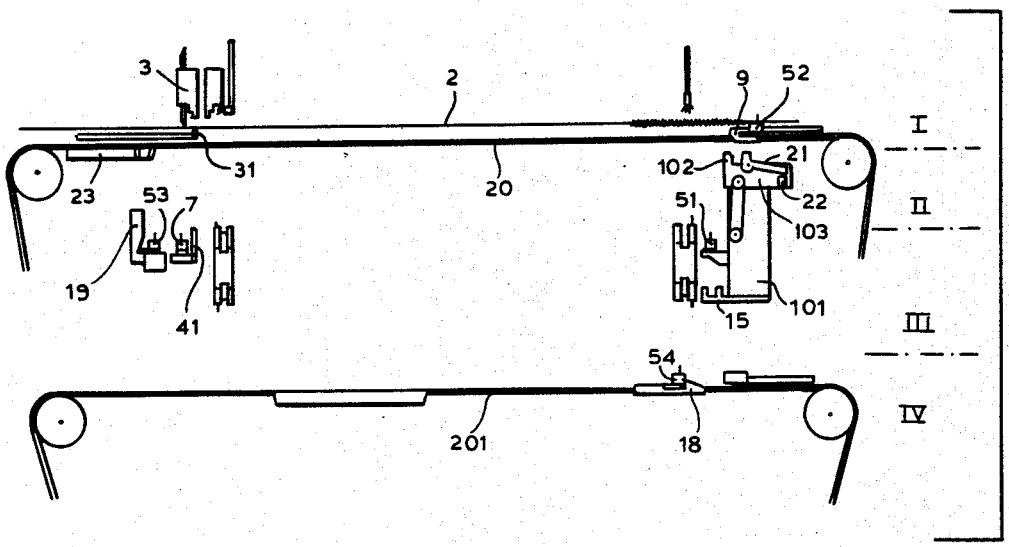

FIG. 3B shows how then the return hook 18 moves downstream to engage the bar 54 and the holder 10 is lifted. The bar 53 is also transferred off the lifter 19. The beam 3 and counterbeam 31 separate to release the web 2 and the slide 103 of the hook 10 moves downstream from position 25 of FIG. 9 into position 7. At the same time the hook 9 pulls the bar 52 and with it the downstream end of the web 2 all the way to position 14*b*.

Figure 3C:
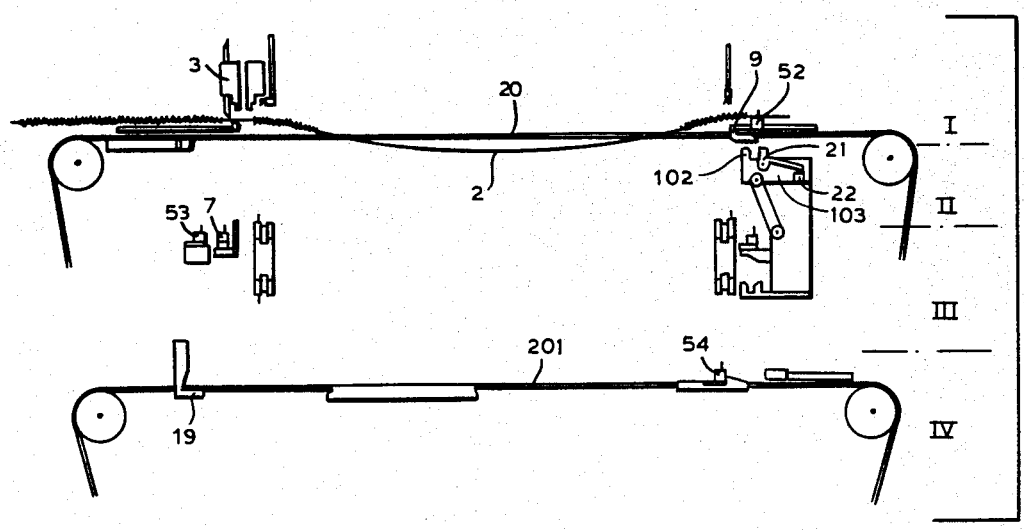

Then as seen in FIG. 3C the hook 9 moves back upstream to position 11 to put a little slack in the web 2 and the lifter 19 moves down underneath the conveyor 201.

Figure 3D:
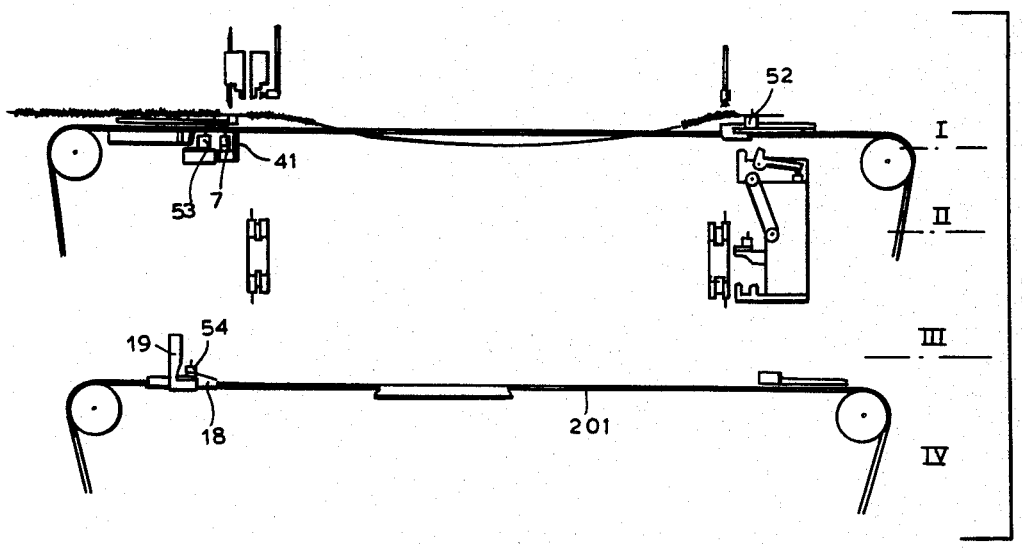

FIG. 3D shows how then the beams 4 and 41 move together with the bar 7 upstream from position 1 into position 2 of FIGS. 4 and 7, moving the beams 3 and 4 relatively close to each other. The hook 10 moves up into position 8 with its slide 103 pushed downstream. The return hook 18 pulls the bar 54 upstream into a position above the lowered lifter 19 so that it can subsequently be lifted by same.

Figure 3E:
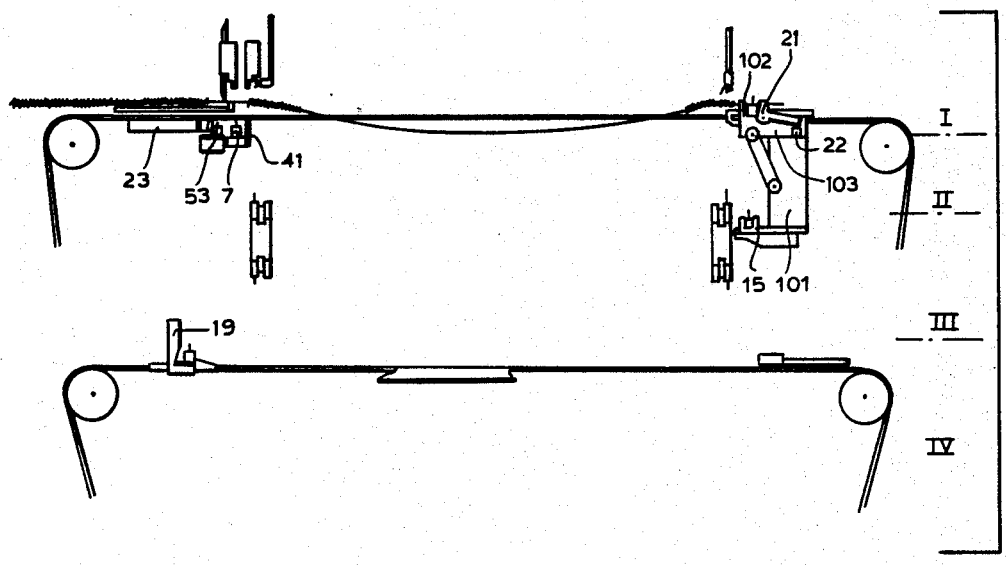

Then as seen in FIG. 3E the counterbeam 41 and the needle bar 7 move up with the bar 53 they are carrying from position 2 into position 3 as shown in FIG. 4 and 7. Meanwhile the hook 10 moves from position 9 (FIG. 9) into position 10 and grabs the bar 52 with the clamp hook 21.

Figure 3F:
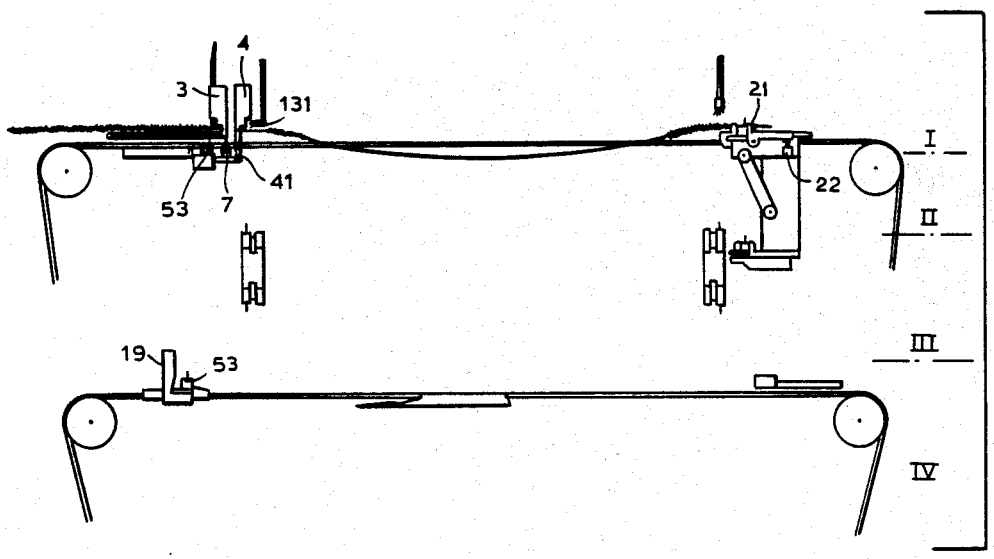

FIG. 3F shows how then the beam 41 and noncirculating needle bar 7 are moved downstream from position 3 to position 4 and the puller 23 moves downstream and couples itself to the bar 53.

Figure 3G:
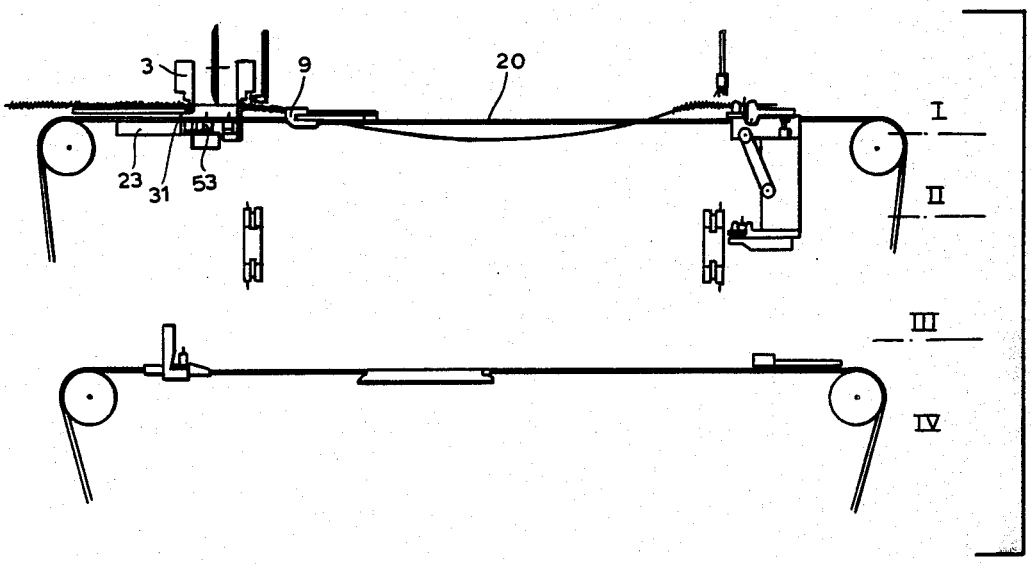

Then as seen in FIG. 3G the hook 9 moves from position 11 into an intermediate position 24. The counterbeam 41 and the needle bar 7 as shown in FIG. 3G move upward with the bar 53 into position 5 as seen also in FIGS. 4 and 7.

Figure 3H:
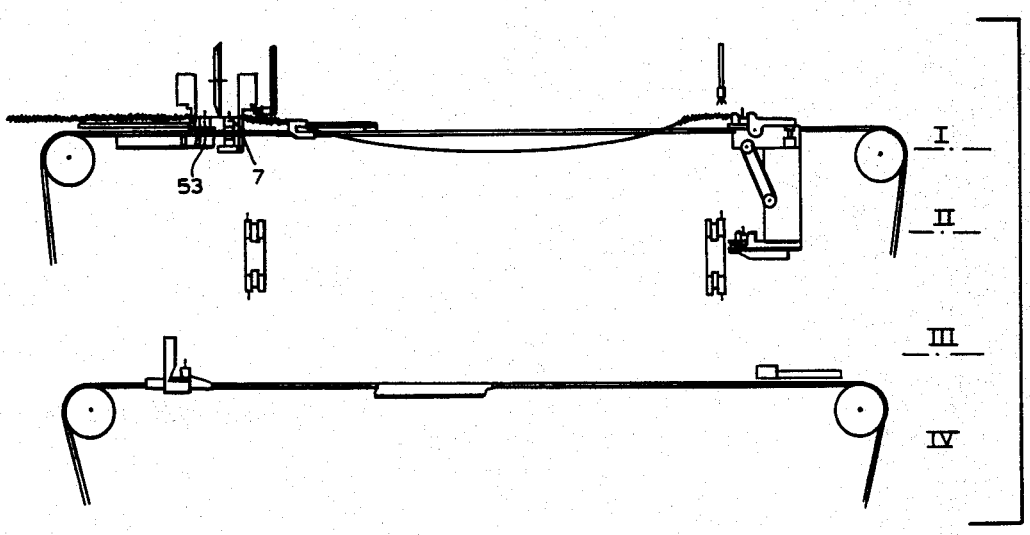

FIG. 3H shows how then the beams 3 and 4 move apart by movement of the beam 3 upstream into the position shown in FIG. 4. The counterbeam 31 pinches the web 2 up against the beam 3 and similarly the beam 4 pinches the goods against the counterbeam 41 and the goods 2 are impaled by the needles of the bar 7.

Figure 3I:
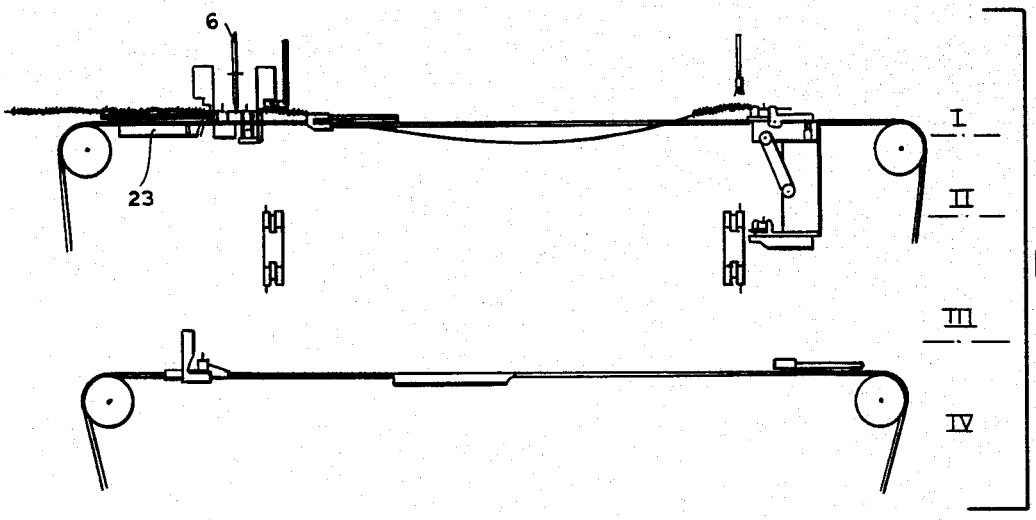

As seen in FIG. 3I the bar 53 held by the puller 23 is moved from position 5 upward so as to poke its needles through the goods 2 and the crosscutter 6 moves laterally to sever the goods 2 between the bar 53 and the bar 7.

Figure 3J:
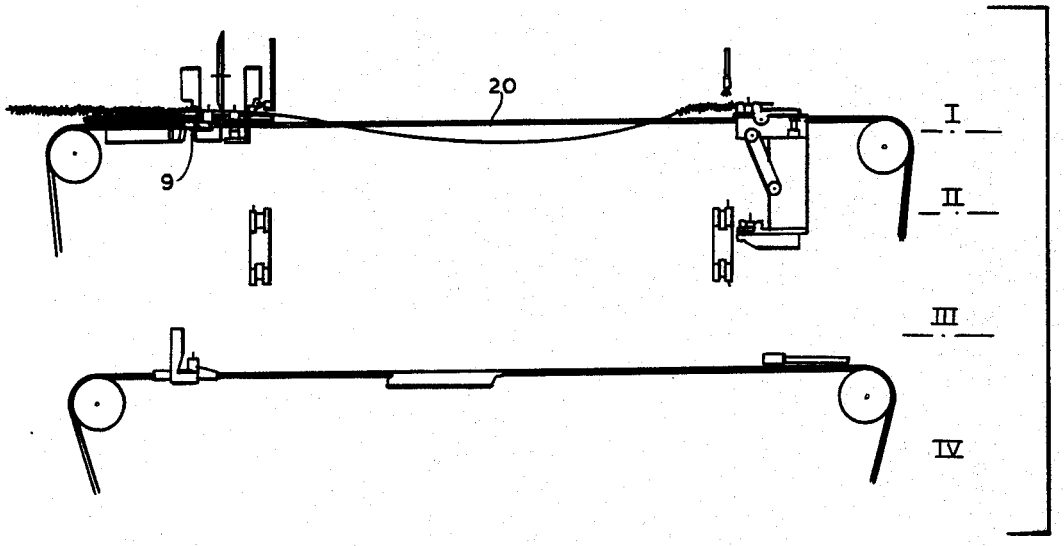

The return hook 9 then as seen in FIG. 3J moves upstream from position 24 into position 13 and the puller 23 releases the needle bar 53 and returns upstream to its starting position.

Figure 3K:
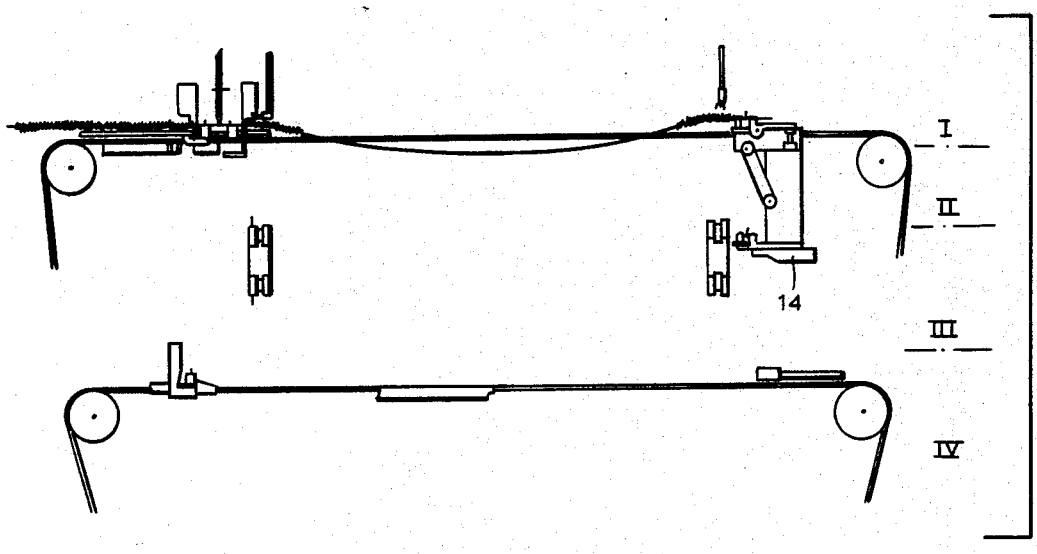
Figure 9:
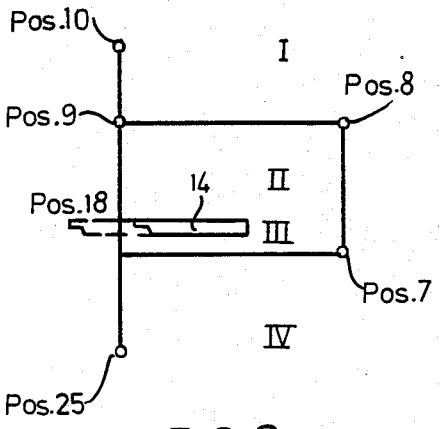
Figure 10:
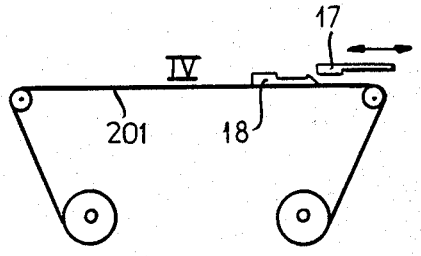

Then as seen in FIGS. 3K and 9 the hook 10 moves from position 10 down into position 25. During this action the slide 14 is advanced upstream into position 18 as soon as the hook 15 is down past it. This action therefore deposits the needle bar 52 on the slide 14 in the position 18.

Figure 3L:
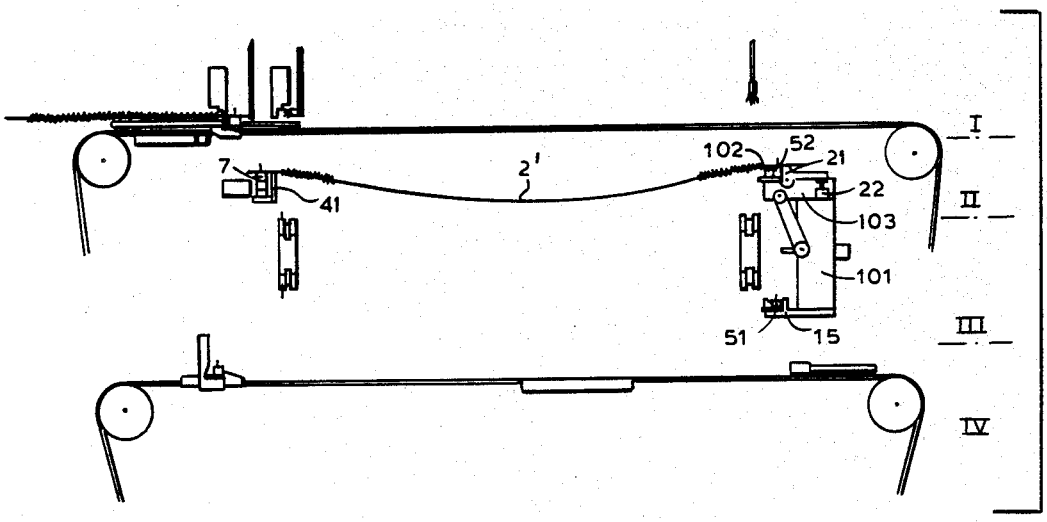
Figure 3M:
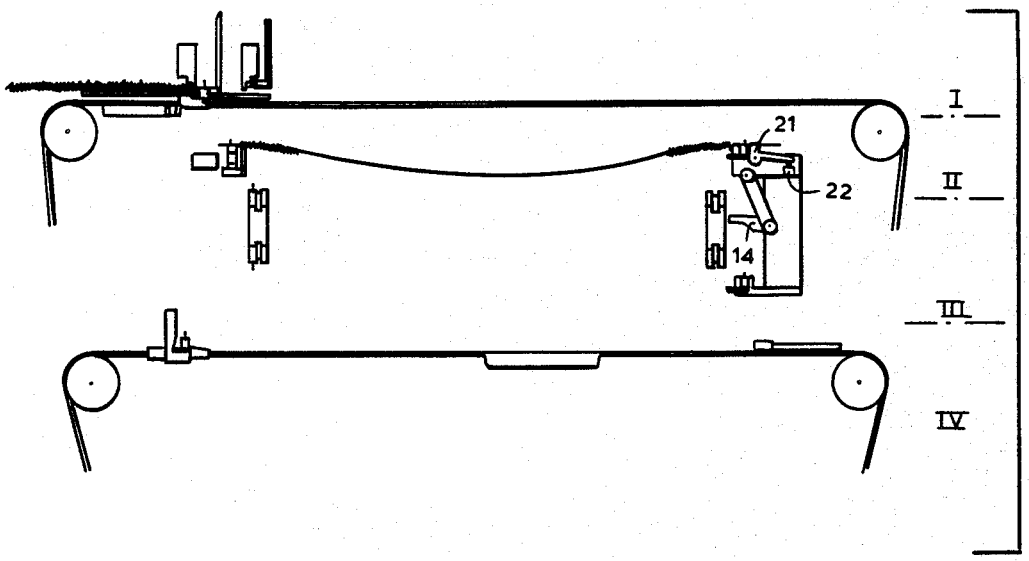
Figure 3N:
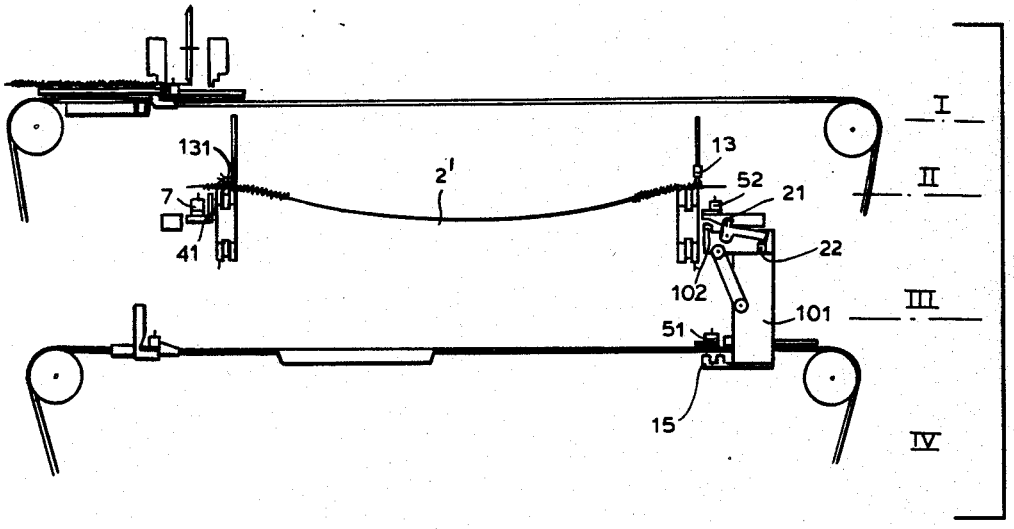
Figure 3O:
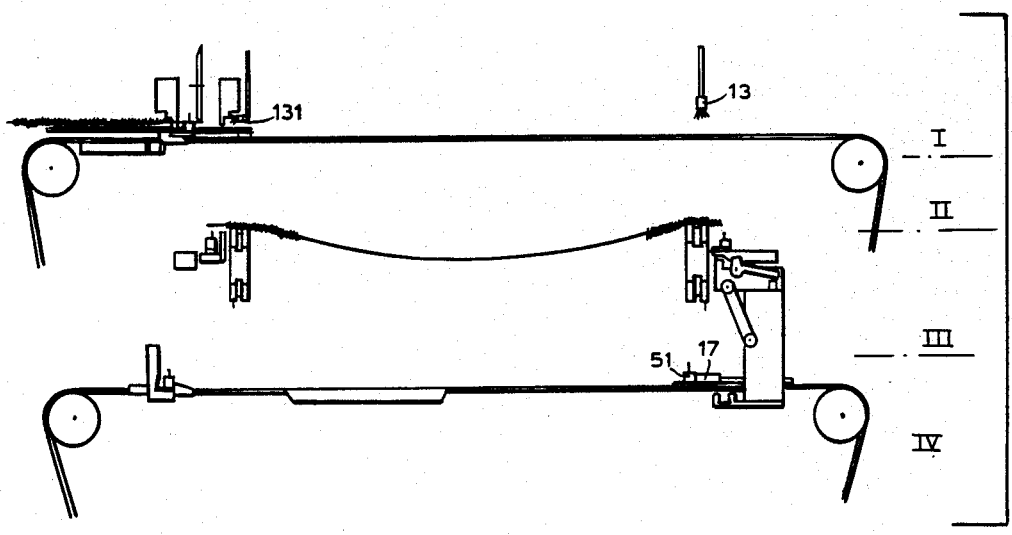

FIG. 3L shows how then, synchronously with the dropping of the bar 52, the noncirculating needle bar 7 and the counterbeam 41 drop. Then as seen in FIG. 3M the clamp arm 21 releases and, with further dropping as seen in FIG. 3N the piece 2' of the web between them is caught on the needles 11*m*, 12*m* of the chain conveyor 11, 12.

Finally as seen in FIGS. 2 and 30 the pusher 17 moves upstream, that is from right to left as seen in the drawing, and pushes the bar 54 on the rails 16 somewhat upstream, then returns to its downstream position. The brushes 13 and 131 push the piece 2' of web 2 down onto the conveyor 11, 12 which is running to move this piece 2' transversely away, that is perpendicular to the plane of view of FIG. 2. The machine then can repeat the sequence of steps outlined above to cut another piece from the web 2.

I claim:

1. A method of cutting pieces from an elongated flexible web and delivering the pieces to a treatment machine, the method comprising the steps of sequentially:

(a) feeding a leading edge of the web to a cutting station downstream in a longitudinal direction with the edge extending transversely and affixing the leading edge at the cutting station to a first one of a plurality of transversely extending circulating needle bars;

(b) advancing the first needle bar longitudinally downstream away from the cutting station to a holding station spaced downstream from the cutting station and arresting the first needle bar in the holding station;

(c) at the cutting station affixing to the web a second one of the transversely extending circulating needle bars and, closely but spacedly downstream therefrom, a noncirculating needle bar;

(d) while maintaining the first and second circulating bars and the noncirculating needle bar substantially stationary, cutting the web transversely between the second circulating bar and the noncirculating bar and thereby cutting a piece from the web, the piece being spanned between a trailing edge at the noncirculating bar and a leading edge at the first circulating needle bar;

(e) dropping the noncirculating and first circulating needle bars with the web piece spanned between them and thereby transferring the piece to a conveyor extending transversely from between the stations to the treatment machine for conveyance of the piece away on the conveyor toward the treatment machine;

(f) advancing the second circulating needle bar longitudinally downstream away from the cutting station to the holding station and arresting the second needle bar in the holding station;

(g) at the cutting station affixing to the web a another one of the transversely extending circulating needle bars and, closely but spacedly downstream therefrom, the noncirculating needle bar; and (h) repeating steps (d) and (e) with the second needle bar and the other needle bar to cut another piece from the web.

2. The method defined in claim 1 wherein the piece is conveyed away transversely to the upstream-to-downstream direction of displacement of the uncut web by a conveyor extending transversely below the holding and cutting stations, the method comprising the step of passing the circulating needle bars each after step (e) upstream underneath the transverse conveyor toward the cutting station.

3. The method defined in claim 1, further comprising the step of clamping the web between upper and lower clamping elements upstream and downstream of the cutting station during step (d).

4. The method defined in claim 1 wherein more than two such circulating bars are used and same are passed from the holding station to the cutting station by being moved downward from the holding station, then upstream toward the cutting station, and finally upward to the cutting station.

* * * * *